US008907872B2

(12) United States Patent
Shin et al.

(10) Patent No.: US 8,907,872 B2
(45) Date of Patent: Dec. 9, 2014

(54) DATA DRIVER AND METHOD OF DRIVING ORGANIC LIGHT EMITTING DISPLAY USING THE SAME

(75) Inventors: Byung-Hyuk Shin, Yongin (KR); Won-Jun Choe, Yongin (KR); Woo-Choul Kim, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 126 days.

(21) Appl. No.: 13/593,856

(22) Filed: Aug. 24, 2012

(65) Prior Publication Data

US 2013/0285997 A1 Oct. 31, 2013

(30) Foreign Application Priority Data

Apr. 27, 2012 (KR) ..... 10-2012-0044374

(51) Int. Cl.
*G09G 3/30* (2006.01)

(52) U.S. Cl.
USPC ..... 345/76; 345/98; 345/204

(58) Field of Classification Search
CPC ..... G09F 3/30; G09F 3/36; G09F 3/3275; G09F 3/3611
USPC ..... 345/76–78, 81, 87, 98, 100, 204
See application file for complete search history.

(56) References Cited

U.S. PATENT DOCUMENTS

2006/0245591 A1* 11/2006 Choi et al.
2008/0309531 A1* 12/2008 Choi et al.

FOREIGN PATENT DOCUMENTS

KR 10-0629583 B1 9/2006
KR 10-2006-0110697 A 10/2006
KR 10-2006-0112981 A 11/2006
KR 10-2011-0079013 A 7/2011

* cited by examiner

*Primary Examiner* — Regina Liang
(74) *Attorney, Agent, or Firm* — Lee & Morse, P.C.

(57) ABSTRACT

A data driver includes a holding latch unit including a plurality of holding latches that store data, a signal generator including a plurality of digital-analog converters (DAC) for receiving the data to generate data signals, and a switching unit coupled between the signal generator and data lines to couple the plurality of DACs to the data lines or to commonly couple one of the plurality of DACs to the data lines.

9 Claims, 4 Drawing Sheets

DATA DRIVER AND METHOD OF DRIVING ORGANIC LIGHT EMITTING DISPLAY USING THE SAME

CROSS-REFERENCE TO RELATED APPLICATION

This application claims priority under 35 U.S.C. §119 to Korean Patent Application No. 10-2012-0044374, filed on Apr. 27, 2012, in the Korean Intellectual Property Office, the entire contents of which are incorporated herein by reference.

BACKGROUND

1. Field

Embodiments relate to a data driver and a method of driving an organic light emitting display using the same.

2. Description of the Related Art

Recently, various flat panel displays (FPD) capable of reducing weight and volume, which are disadvantages of cathode ray tubes (CRT), have been developed. The FPDs include liquid crystal displays (LCD), field emission displays (FED), plasma display panels (PDP), and organic light emitting displays.

Among the FPDs, the organic light emitting displays display images using organic light emitting diodes (OLED) that generate light by the re-combination of electrons and holes. The organic light emitting display has a high response speed and is driven with a low power consumption.

SUMMARY

Embodiments are directed to a data driver, including a holding latch unit including a plurality of holding latches that store data, a signal generator including a plurality of digital-analog converters (DAC) for receiving the data to generate data signals, and a switching unit coupled between the signal generator and data lines to couple the plurality of DACs to the data lines or to commonly couple one of the plurality of DACs to the data lines.

The switching unit may commonly couple one of the plurality of DACs to the data lines when a same voltage is supplied to the data lines. The data driver may further include a gamma voltage generator coupled to the signal generator to generate a plurality of gamma voltages. The data driver may further include an output stage including a plurality of buffers between the switching unit and the data lines. The data driver may further include a shift register unit for sequentially generating sampling signals and a sampling latch unit for storing the data in response to the sampling signals and for supplying the stored data to the holding latch unit.

Embodiments are also directed to an organic light emitting display, including a scan driver for supplying scan signals to scan lines, a data driver for supplying data signals to data lines, a timing controller for controlling the scan driver and the data driver, and a plurality of pixels positioned to be coupled to the scan lines and the data lines. The data driver includes a holding latch unit including a plurality of holding latches that store data, a signal generator including a plurality of DACs for receiving the data to generate the data signals, and a switching unit coupled between the signal generator and the data lines to couple the plurality of DACs to the data lines when a control signal is not supplied and to commonly couple one of the plurality of DACs to the data lines when the control signal is supplied.

The timing controller may supply the control signal when a same voltage is supplied to the data lines.

Embodiments are also directed to an organic light emitting display, the method including generating voltages to be supplied to data lines using a plurality of DACs and supplying the voltages to pixels via the data lines. When the voltages to be supplied to the data lines are set as a same voltage, the voltage supplied to the data lines may be generated by one DAC of the plurality of DACs.

When the voltages to be supplied to the data lines are set as different voltages, the voltages supplied to the data lines may be generated by the different DACs.

BRIEF DESCRIPTION OF THE DRAWINGS

Features will become apparent to those of skill in the art by describing in detail exemplary embodiments with reference to the attached drawings in which.

DETAILED DESCRIPTION

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope thereof to those skilled in the art.

Figure 1:
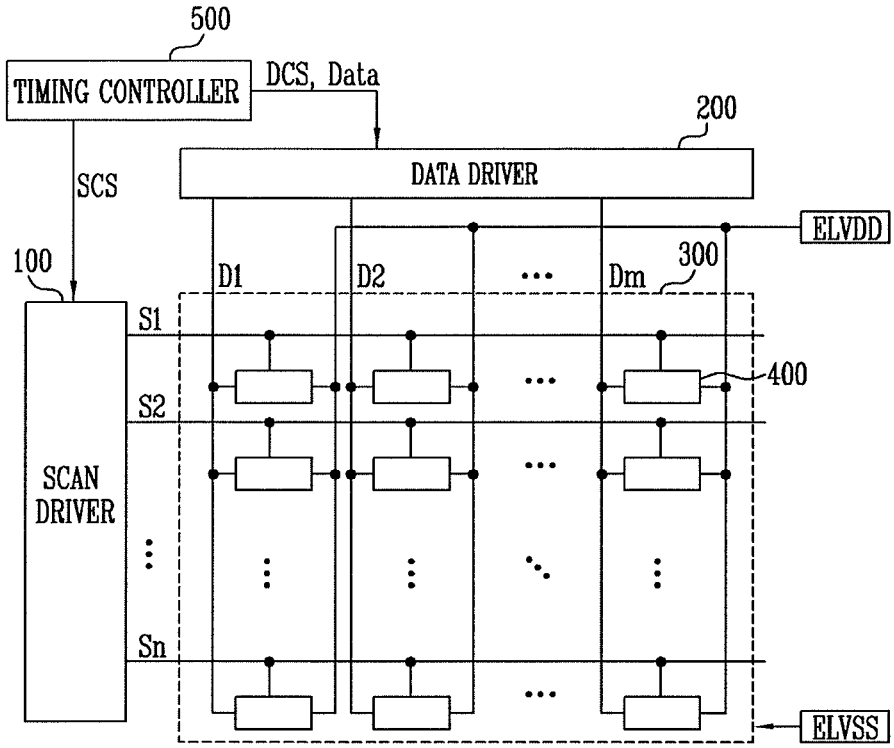
FIG. 1 is a view illustrating an organic light emitting display according to an embodiment.

FIG. 1 is a view illustrating an organic light emitting display according to an embodiment.

Referring to FIG. 1, the organic light emitting display according to the embodiment includes a pixel unit 300 including a plurality of pixels 400 coupled to scan lines S1 to Sn and data lines D1 to Dm, a scan driver 100 for driving the scan lines S1 to Sn, a data driver 200 for driving the data lines D1 to Dm, and a timing controller 500 for controlling the scan driver 100 and the data driver 200.

The timing controller 500 generates a data driving control signal DCS and a scan driving control signal SCS to correspond to synchronizing signals supplied from the outside. The data driving control signal DCS generated by the timing controller 500 is supplied to the data driver 200 and the scan driving control signal SCS generated by the timing controller 500 is supplied to the scan driver 100. The timing controller 500 supplies data Data supplied from the outside to the data driver 200.

The scan driver 100 receives the scan driving control signal SCS from the timing controller 500. The scan driver 100 that receives the scan driving control signal SCS sequentially supplies scan signals to the scan lines S1 to Sn. That is, the scan driver 100 selects the pixels 400 to which data signals are to be supplied while sequentially supplying the scan signals to the scan lines S1 to Sn.

The data driver 200 receives the data driving control signal DCS from the timing controller 500. The data driver 200 that receives the data driving control signal DCS generates the data signals and supplies the generated data signals to the data lines D1 to Dm in synchronization with the scan signals. It is to be understood that the data driver 200 may be formed of a plurality of data integrated circuits (not shown) to correspond to the number of channels. However, for convenience sake, it is assumed herein that the data driver 200 is formed of one integrated circuit.

The pixel unit 300 includes the pixels 400 formed at the intersections of the scan lines S1 to Sn and the data lines D1 to Dm. Each of the pixels 400 receives a first power source ELVDD and a second power source ELVSS. The pixels 400 charge predetermined voltages to correspond to the data signals and supply currents corresponding to the charged voltages from the first power source ELVDD to the second power source ELVSS via organic light emitting diodes (not shown) to display an image with predetermined brightness.

Figure 2:
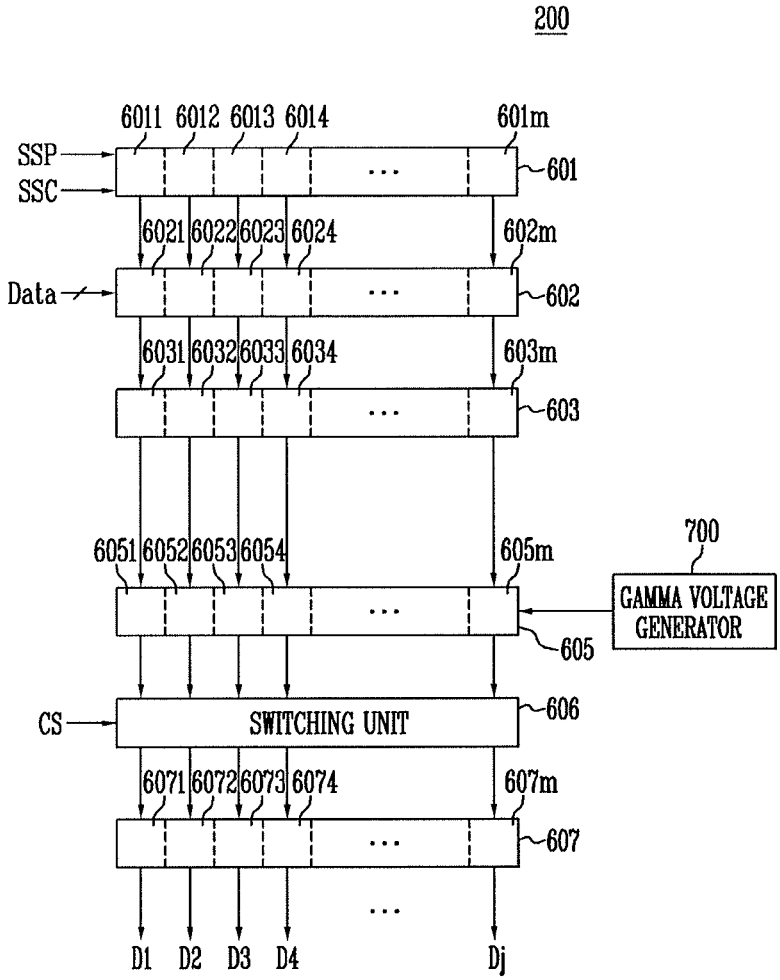
FIG. 2 is a view illustrating a data driver according to a first embodiment.

FIG. 2 is a view illustrating a data driver 200 according to a first embodiment.

Referring to FIG. 2, the data driver 200 according to the first embodiment includes a shift register unit 601, a sampling latch unit 602, a holding latch unit 603, a signal generator 605, a switching unit 606, and an output stage 607.

In addition, the data driver 200 according to the present embodiment includes a gamma voltage generator 700 for generating a plurality of gamma voltages. The gamma voltage generator 700 generates a plurality of gamma voltages so that gray scales may be realized to correspond to data and supplies the generated gamma voltages to the signal generator 605. In addition, the gamma voltage generator 700 generates an additional voltage other than the data signals to correspond to a driving method and supplies the generated voltage to the signal generator 605. The gamma voltage generator 700 may be provided inside or outside of the data driver 200.

The shift register unit 601 receives a source start pulse SSP and a source shift clock SSC from the outside. The shift register unit 601 that receives the source start pulse SSP and the source shift clock SSC sequentially generates m sampling signals while shifting the source start pulse SSP every one period of the source shift clock SSC. Therefore, the shift register unit 601 includes m shift registers 6011 to 601*m*.

The sampling latch unit 602 sequentially stores data Data in response to the sampling signals sequentially supplied from the shift register unit 601. Therefore, the sampling latch unit 602 includes m sampling latches 6021 to 602*m* in order to store m data Data. Here, the storage capacity of each of the sampling latches 6021 to 602*m* is set so as to store data Data of a predetermined bit.

The holding latch unit 603 receives the data Data from the sampling latch unit 602 to store the received data Data. The holding latch unit 603 supplies the data Data stored therein to the signal generator 605. Therefore, the holding latch unit 603 includes m holding latches 6031 to 603*m*. Here, the storage capacity of each of the holding latches 6031 to 603*m* is set so as to store data Data of a predetermined bit.

The signal generator 605 receives the data Data from the holding latch unit 603 and generates the data signals to correspond to the received data Data. Therefore, the signal generator 604 includes m DACs (digital-analog converters) 6051 to 605*m*. Each of the DACs 6051 to 605*m* selects one of the plurality of gamma voltages supplied from the gamma voltage generator 700 to correspond to the bit of the data Data input thereto and outputs the selected gamma voltage as a data signal. In addition, the DACs 6051 to 605*m* select a specific voltage, that is, the same voltage supplied to the gamma voltage generator 700 to correspond to data and output the selected voltage to the switching unit 606.

The switching unit 606 transmits the data signals supplied from the signal generator 605 to the output stage 607. Here, the switching unit 606 controls coupling between the signal generator 605 and the output stage 607 to correspond to a control signal CS.

Describing the above in detail, the timing controller 500 supplies the control signal CS when the same data signal and/or the same voltage are to be supplied to the data lines D1 to Dm and does not supply the control signal CS in the other cases.

Figure 3A:
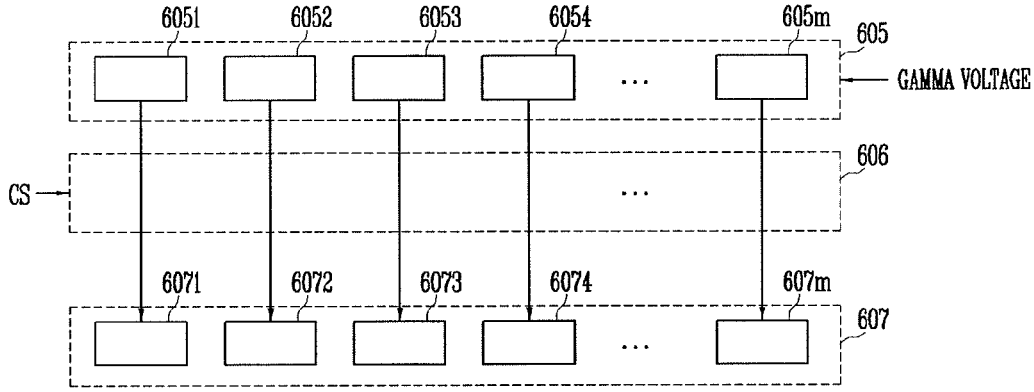
FIGS. 3A and 3B are views illustrating the operation processes of the switching unit of FIG. 2.

When the control signal CS is not supplied, the switching unit 606 couples the respective channels of the signal generator 605 to the respective channels of the output stage 607 as illustrated in FIG. 3A. Then, the output stage 607 supplies the data signals supplied from the DACs 6051 to 605*m* to the data lines D1 to Dm.

Figure 3B:
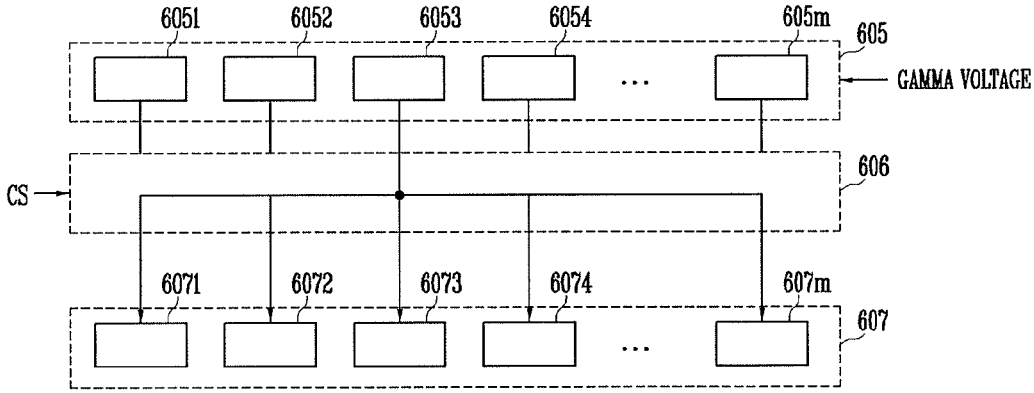

When the control signal CS is supplied, the switching unit 606 supplies the data signal (or a predetermined voltage) supplied from one DAC 6053 of the plurality of DACs 6051 to 605*m* included in the signal generator 605 to the respective channels of the output stage 607 as illustrated in FIG. 3B. Then, the output stage 607 supplies the data signal supplied from one DAC 6053 to the data lines D1 to Dm.

According to the present embodiment, in a period where the same voltage (and/or the same data signal) is supplied to the data lines D1 to Dm, the voltage generated by one DAC 6053 is supplied to the data lines D1 to Dm so that the same voltage may be supplied to the data lines D1 to Dm. Then, the voltages supplied to the pixels 400 are set to be the same so that display quality may be improved.

The output stage 607 receives the data signals (or voltages) from the switching unit 606. Therefore, buffers 6071 to 607*m* are formed in the respective channels of the output stage 607. The buffers 6071 to 607*m* transmit the data signals supplied thereto to the data lines D1 to Dm coupled thereto. On the other hand, the output stage 607 may be omitted according to the intention of a designer. In this case, the switching unit 606 is directly coupled to the data lines D1 to Dm.

Figure 4:
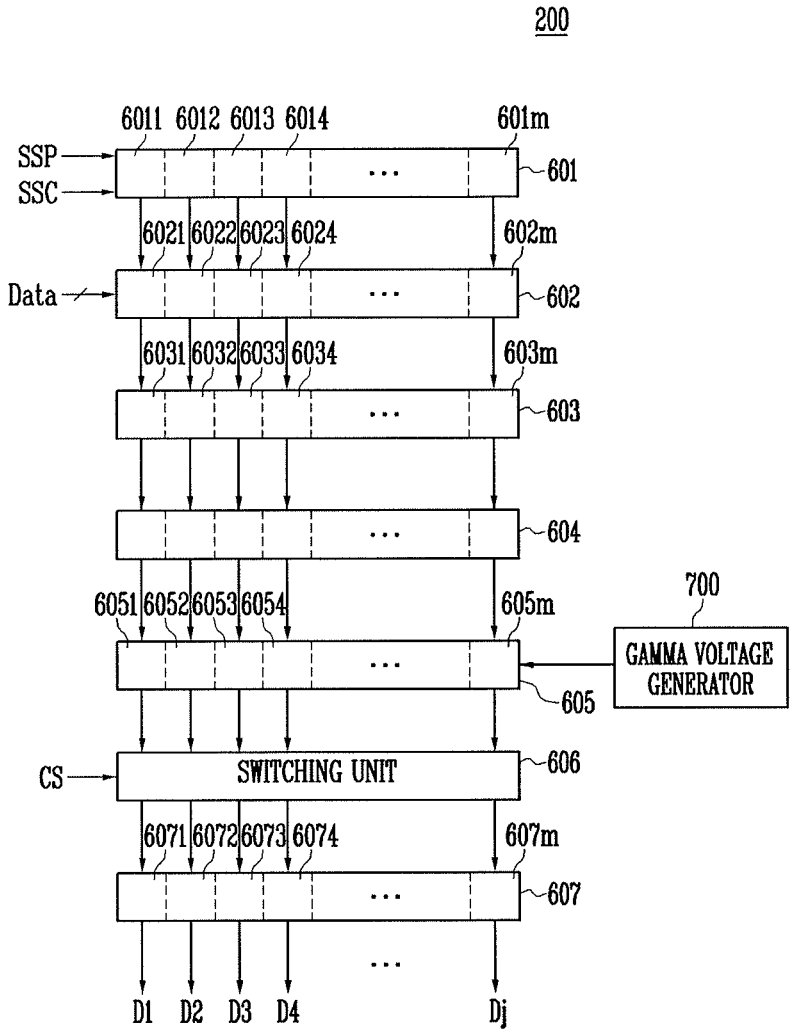
FIG. 4 is a view illustrating a data driver according to a second embodiment.

FIG. 4 is a view illustrating a data driver according to a second embodiment. In FIG. 4, the same elements as the elements of FIG. 2 are denoted by the same reference numerals and detailed description thereof will not be repeated.

Referring to FIG. 4, the data driver 200 according to the second embodiment further includes a level shifter unit 604 provided between the holding latch unit 603 and the signal generator 605. The level shifter unit 604 increases the voltage level of the data Data supplied from the holding latch unit 603 to supply the data Data to the signal generator 605. When data Data having a high voltage level is supplied from an external system to the data driving circuit 200, circuit parts corresponding to the high voltage level may need to be provided in the light emitting display. Accordingly, manufacturing cost may increase. Therefore, data Data having a low voltage level may be supplied from the outside of the data driving circuit 200, and the data Data having the low voltage level may be boosted to the high voltage level by the level shifter unit 604. Then, circuit parts corresponding to the low voltage level may be provided in the light emitting display so that manufacturing cost may be reduced.

By way of summation and review, an organic light emitting display may include a plurality of pixels positioned at the intersections of data lines and scan lines. The scan lines receive, or, for example, sequentially receive scan signals from a scan driver. The data lines receive data signals from a data driver in synchronization with the scan signals. Pixels are selected when the scan signals are supplied to charge voltages corresponding to the data signals. In the pixels, currents corresponding to the charged voltages are supplied to light emitting diodes (LED) to generate light with predetermined brightness. In this case, the light with the predetermined brightness that is emitted from the pixels may be combined so that a predetermined image is displayed on a pixel unit.

The organic light emitting display may be driven by various types of driving methods. In particular, a method of supplying the same voltage to the data lines to set the pixels in a specific state (for example, initialization) and to realize gray scales may be used.

However, due to a deviation in digital-analog converters positioned in the respective channels of the data driver, voltages supplied to the data lines may vary so that display quality deteriorates. Although processes may be precisely controlled when the DACs are manufactured, the DACs positioned in the respective channels may have a predetermined deviation. Therefore, when the same voltage is supplied to the data lines, the voltages supplied to the respective channels may be set to vary due to the deviations in the DACs.

Embodiments may provide a data driver capable of improving display quality and a method of driving an organic light emitting display using the same. In the data driver and the method of driving the organic light emitting display using the same, when the same voltage is supplied to the data lines, the data lines receive a voltage from one DAC so that display quality may be improved.

While embodiments have been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A data driver, comprising:

a holding latch unit including a plurality of holding latches that store data;

a signal generator including a plurality of digital-analog converters (DACs) that receive the data to generate data signals; and a switching unit for selectively connecting between the signal generator and data lines, wherein the respective of the plurality of DACs is coupled to each of the data lines when a control signal is not supplied to the switching unit and a single DAC of the plurality of DACs is commonly coupled to the respective data lines when the control signal is supplied to the switching unit.

2. The data driver as claimed in claim 1, wherein the switching unit commonly couples the single DAC of the plurality of DACs to the data lines when a same voltage is supplied to the data lines.

3. The data driver as claimed in claim 1, further comprising a gamma voltage generator coupled to the signal generator to generate a plurality of gamma voltages.

4. The data driver as claimed in claim 1, further comprising an output stage including a plurality of buffers between the switching unit and the data lines.

5. The data driver as claimed in claim 1, further comprising:

a shift register unit for sequentially generating sampling signals; and a sampling latch unit for storing the data in response to the sampling signals and for supplying the stored data to the holding latch unit.

6. An organic light emitting display, comprising:

a scan driver for supplying scan signals to scan lines;

a data driver for supplying data signals to data lines;

a timing controller for controlling the scan driver and the data driver; and a plurality of pixels coupled to the scan lines and the data lines, wherein the data driver includes:

a holding latch unit including a plurality of holding latches that store data;

a signal generator including a plurality of digital-analog converters (DACs) that receive the data to generate the data signals; and a switching unit coupled between the signal generator and the data lines, wherein the respective of the plurality of DACs is coupled to each of the data lines when a control signal is not supplied to the switching unit and a single DAC of the plurality of DACs is commonly coupled to the respective data lines when the control signal is supplied to the switching unit.

7. The organic light emitting display as claimed in claim 6, wherein the timing controller supplies the control signal when a same voltage is supplied to the data lines.

8. A method of driving an organic light emitting display, the method comprising:

generating voltages to be supplied to data lines using a plurality of digital-analog converters (DACs); and supplying the voltages to pixels via the data lines, wherein when the voltages to be supplied to the data lines are set as a same voltage, a single voltage generated by a single DAC of the plurality of DACs is commonly supplied to the pixels via to the data lines.

9. The method as claimed in claim 8, wherein, when the voltages to be supplied to the data lines are set as different voltages, the voltages supplied to the data lines are generated by the respective DACs of the plurality of DACs.

* * * * *